US005968449A

United States Patent [19]

Aoki et al.

[11] Patent Number: 5,968,449

[45] Date of Patent: Oct. 19, 1999

[54] IRON BASE SI—MN ALLOY OR IRON BASE SI—MN—NI ALLOY HAVING GOOD CRUSHABILITY AND ALLOY POWDER THEREOF

[75] Inventors: Koichi Aoki, Yokohama; Atsuo Onoda, Tokyo; Masao Kamada, Kazo; Hitoshi Nishimura, Yamato; Kuniteru Suzuki, Yokohama; Shunji Kikuchi, Ichikawa, all of Japan

[73] Assignees: Nippon Steel Welding Products & Engineering Co., Ltd.; Japan Metals & Chemicals Co., Ltd., both of Tokyo, Japan

[21] Appl. No.: 09/009,299

[22] Filed: Jan. 20, 1998

[30] Foreign Application Priority Data

Jul. 28, 1997 [JP] Japan ..... 9-201591

[51] Int. Cl.[6] ..... C22C 38/02; C22C 38/04

[52] U.S. Cl. ..... 420/72; 420/73; 420/581; 75/255; 75/230

[58] Field of Search ..... 75/255, 230; 420/72, 420/73, 581

[56] References Cited

FOREIGN PATENT DOCUMENTS 57-185958 11/1982 Japan ..... 420/72
4-62838 10/1992 Japan .
4-72640 11/1992 Japan .
5-31594 2/1993 Japan .

*Primary Examiner*—Deborah Yee
*Attorney, Agent, or Firm*—Wenderoth, Lind & Ponack, L.L.P.

[57] ABSTRACT

An object of the present invention is to provide an iron base Si—Mn alloy or an iron base Si—Mn—Ni alloy which can be easily crushed and can be manufactured in large quantity, and alloy powder thereof.

An iron base Si—Mn—Ni alloy having good crushability and alloy powder thereof, comprising:

C: 0.40 to 1.20% by weight,

Si: 5.0 to 12.0% by weight,

Mn: 19.0 to 42.0 % by weight, or Ni: not more than 30% by weight, and the balance being Fe, with the following equations satisfied: $Si \geqq 11.89-2.92\ C-0.077\ Mn$, Vickers hardness $(Hv) \geqq 550$, and area ratio of dendrite structure $\leqq 50\%$.

An iron base Si—Mn—Ni alloy having good crushability and alloy powder thereof, comprising:

C: 0.40 to 1.20% by weight,

Si: 5.0 to 12.0% by weight,

Mn: 19.0 to 42.0% by weight, or Ni: not more than 30% by weight, and the balance being Fe, with the following equations satisfied: $Si \leqq 8.3\ C+0.14\ Mn$, and relative permeability $(\mu) \leqq 1.10$.

16 Claims, 3 Drawing Sheets

IRON BASE SI— MN ALLOY OR IRON BASE SI— MN— NI ALLOY HAVING GOOD CRUSHABILITY AND ALLOY POWDER THEREOF

BACKGROUND OF THE INVENTION

1. Field of the Invention

The present invention relates to an iron base Si—Mn alloy or an iron base Si—Mn—Ni alloy, particularly having good crushability and alloy powder thereof.

2. Description of the Prior Art

Ferromanganese, ferrosilicon, and silicon-manganese which have been conventionally used mainly as a deoxidizing agent, a desulphurizing agent, a slagging agent and an alloying component addition agent when iron and steel are manufactured, as stipulated in the Japanese Industrial Standard (hereinafter referred to as JIS") (G2301, G2302, G2304—1986), contain large amounts of alloying components (for example, Mn≧73%, (Mn+Si)≧74%) and also have an extremely high carbon content (for example, FMnM2: C≦2.0%, SiMnO: C≦1.5%). And these ferroalloys are usually supplied as alloy powder or alloy particle according to a particle size stipulated for use. That is to say, these ferroalloys, as shown in a method for making a lot in JIS, have a feature in the properties thereof that they are supplied in large quantity and in powder form or in particle form, which is realized by the fact that they have the high contents of alloying components and carbon and that they are easily made into powder form or particle form after they are molt en and cooled. On the other hand, in recent years, as the variety of steel products has been increased, there have been more demanded ferroalloys in powder form which have the lower contents of Si, Mn and C than those stipulated in the JIS. For example, the flux of a flux cored wire for arc welding applied to the welding of a steel structure contains various kinds of powder materials such as a slagging agent, a deoxidizing agent, an alloying addition agent, iron powder and the like according to the object and, to be more specific, it contains dozens % total of above described ferromanganese, ferrosilicon, and silicon-manganese in powder form and iron powder. The segregation of the components caused by these mixed flux has a bad effect on the quality of the welded steel products in some cases.

Therefore, it is strongly desired that the simple ferroalloy powder having the same composition as the composition made by blending some kinds of powder materials described above is made in advance and used for the flux. But, in general, as the contents of Si, Mn and C are reduced in a ferroalloy, the ductility and the toughness of the ferroalloy are gradually improved and thus it is difficult to manufacture a product in powder or particle form by using conventional manufacturing equipment. If the composition of the ferroalloy is adjusted so as to solve the problems, the ferroalloy powder is apt to bear magnetism. When a flux cored wire is manufactured, for example, by using the flux mixed with the ferroalloy powder bearing magnetism and by continuously forming a steel strip, filling the flux and performing seam welding as proposed in Japanese Examined Patent Publication No. 4-72640, the segregation of the components and incomplete fusion in the seamed portion and the like might occur in some manufacturing conditions and thus have a bad effect on the manufacturing yield of the flux cored wire and the quality of the welded steel products. Moreover, for example, the flux of the flux cored wire for arc welding applied to the welding of a steel structure made of high-tensile steel or low-temperature steel usually contains Si, Mn, Ni, iron powder and the like together. The above described ferrosilicon, ferromanganese, silicon-manganese, ferronickel in powder or particle form and the like are mainly used as these raw materials in addition to simple raw materials (Si powder, Mn powder and Ni powder). These alloying components of Si, Mn, and Ni strongly react with each other to decrease the quality of the welded part. Therefore, it is desirable that the flux blended and mixed with the raw materials does not have the segregation of components which is apt to be caused by the lot-by-lot compositional variations of the raw materials and the kind-by-kind difference in particle diameter of the raw materials and that the flux has a flux composition containing the predetermined amounts of Si, Mn and Ni. As a result, this requires simple iron base Si—Mn alloy powder containing Ni.

SUMMARY OF THE INVENTION

Therefore, when the iron base Si—Mn alloy powder or the iron base Si—Mn—Ni alloy powder which has a high iron content as described above is manufactured in powder form in large quantity, the raw materials for it must be easily crushed in the manufacturing process. Fe—Mn base alloy powder is disclosed as the alloy powder having a high iron content in Japanese Examined Patent Publication No. 4-62838 and Japanese Unexamined Patent Publication No. 5-31594, but it has a drawback that it is extremely hard to crush by a conventional mechanical crushing machine. This being the case, a ferroalloy which can be easily crushed into iron base Si—Mn alloy powder or iron base Si—Mn—Ni alloy powder and can be manufactured in large quantity has not existed in actuality. Moreover, if the alloy powder is non-magnetic, it can be put to various uses.

An object of the present invention is to provide a ferroalloy, that is, an iron base Si—Mn alloy or an iron base Si—Mn—Ni alloy which does not exist at the present time and can be easily crushed into powder form and manufactured in large quantity, as described above, and the powder thereof.

(1) In accordance with one aspect of the present invention, there is provided an iron base Si—Mn alloy having good crushability, comprising:

C: 0.40 to 1.20% by weight,

Si: 5.0 to 12.0% by weight,

Mn: 19.0 to 42.0% by weight, and the balance being Fe, with the following equations satisfied:

$$Si \geqq 11.89-2.92\ C-0.077\ Mn,$$

Vickers hardness (Hv)≧550, and area ratio of dendrite of structure≦50%.

(2) In accordance with another aspect of the present invention, there is provided an iron base Si—Mn alloy having good crushability, comprising:

C: 0.40 to 1.20% by weight,

Si: 5.0 to 12.0% by weight,

Mn: 19.0 to 42.0% by weight, and the balance being Fe, with the following equations satisfied:

$$Si \geqq 11.89-2.92\ C-0.077\ Mn,$$

$$Si \leqq 8.3\ C+0.14\ Mn,$$

Vickers hardness (Hv)≧550, area ratio of dendrite of structure≦50%.

relative permeability ($\mu$)≦1.10.

According to the present invention, there are also provided;

(3) an iron base Si—Mn alloy having good crushability as in either (1) or (2) described above, further comprising 0.10 to 0.40% by weight of P, (4) iron base Si—Mn alloy powder made of an iron base Si—Mn alloy having good crushability as in any of (1) to (3) described above, wherein a particle size is not more than 212 $\mu$m, (5) an iron base Si—Mn alloy having good crushability as in any of (1) to (3) described above, further comprising not more than 30% by weight of Ni, and (6) iron base Si—Mn—Ni alloy powder made of an iron base Si—Mn—Ni alloy having good crushability as in (5) described above, wherein a particle size is not more than 212 $\mu$m.

EXPLANATION OF REFERENCE NUMERALS

1. outer cylinder
2. inner cylindrical ring
3. bottom member
4. top cover
5. slab

DETAILED DESCRIPTION OF THE INVENTION

The present invention will be described in detail according to the drawings.

Figure 1:
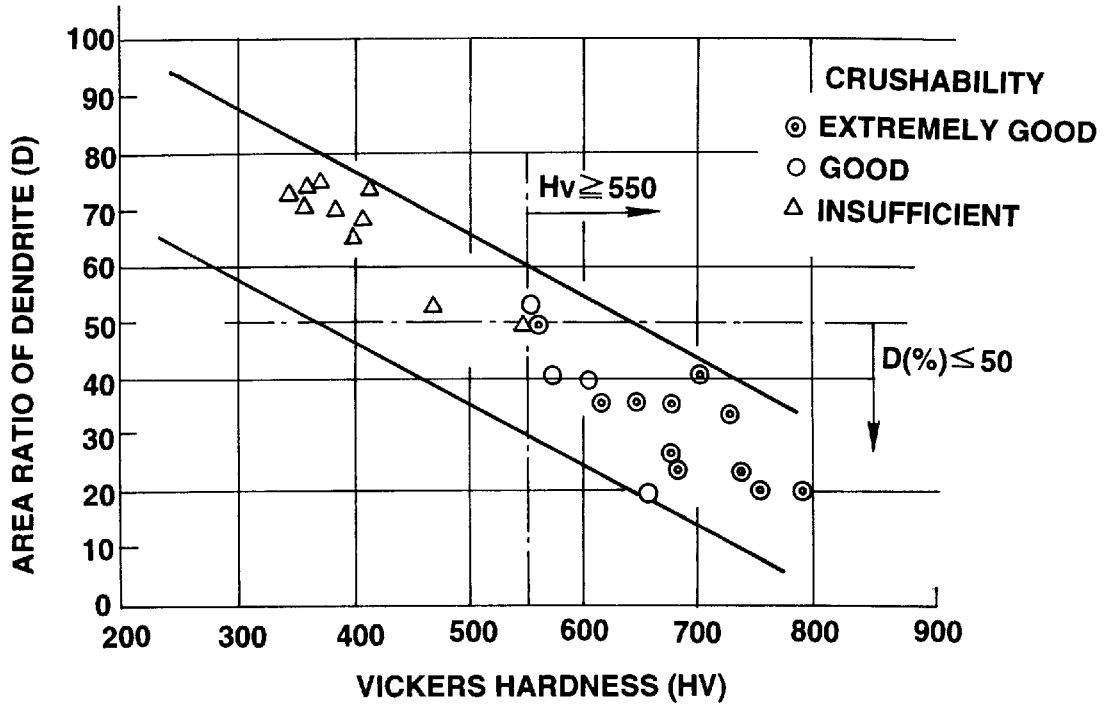
FIG. 1 shows the relationship between the Vickers hardness (Hv) and the area ratio of denderite phase (%) of a ferroalloy slab according to the present invention observed by an optical microscope.
Figure 2:
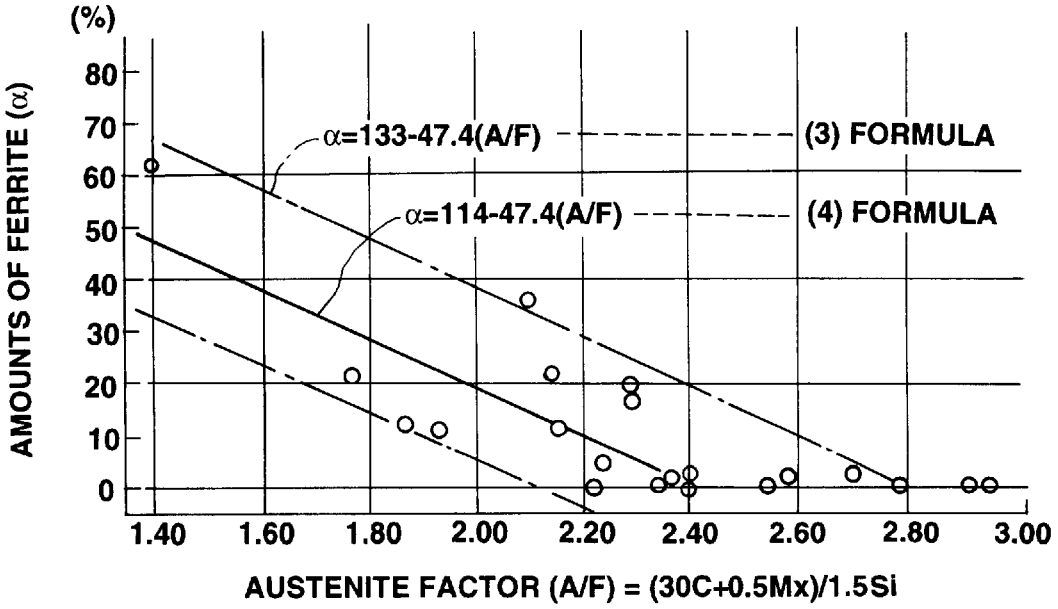
FIG. 2 shows the relationship between the chemical composition and the magnetism of Si—Mn ferroalloys including the present invention.

FIG. 1 is a drawing showing the relationship between the Vickers hardness (Hv) of a ferroalloy slab according to the present invention and the area ratio of dendrite phase (%) thereof observed by an optical microscope. As shown in FIG. 1, the crushability of the ferroalloy of this kind has a strong correlation between the hardness (Hv) and the area ratio of dendrite (%) of the slab. It can be seen from the drawing that crushing is easily performed by making the area ratio of dendrite not more than 50% and the hardness (Hv) not less than 550. The relationship between the chemical composition and the magnetism was determined for the slabs of Si—Mn ferroalloys including the present invention and the results are shown in FIG. 2. A vertical axis shows the amounts (%) of ferromagnetism contained in the slab which is measured by a ferrite meter and a horizontal axis shows A/F (hereinafter referred to as austenite factor") which is determined by the contents of C, Si, and Mn of the slab, as shown in the drawing. As the austenite factor is larger, the slab is apt to be more austenitic. It can be seen from FIG. 2 that, as the austenite factor is larger, the amount of ferrite which indicates the magnetism of the slab is smaller almost linearly and, even if variations are taken into account, when the austenite factor is 2.40 to 2.80, the amount of ferrite is almost zero, that is, the slab is non-magnetized, and, when the austenite factor is higher than 2.80, ferrite disappears completely, which means that the slab is wholly non-magnetized.

Next, the reasons why the amounts of the alloying components are limited in the present invention will be described from the viewpoint of crushability and non-magnetization. In the first place, the relationship between the Vickers hardness (Hv) and the chemical composition which has an important effect on crushability was determined by a series of tests and could be expressed by an equation. The equation is shown as follows: Hv=380 C+130 Si+10 Mn+[P]−1076, where each component is weight %, [P]=80 (P≧0.10%) and [P]=0 (P<0.10%).

From the results shown in FIG. 1 that the crushability is improved when the Vickers hardness (Hv) is not less than about 550, the combination of the contents of C, Si, Mn, and P for obtaining an iron base Si—Mn alloy having the good crushability is determined naturally by the above described equation. It can be understood from this equation that the effects of C, Si, and Mn on the hardness (Hv) are increased in order of Mn<Si<C, but that, taking into account the range of each component content claimed by the present invention, the effect of Si (coefficient=130) is the strongest practically.

Therefore, for example, when the content of Si is the lowest in the range of the claim, or 5%, the contents of C, Mn, and P which are required for ensuring the Vickers hardness of not less than 550 were determined by the experiments. The experiments are shown in No. 1, No, 2 in Table 1. The crushability of No. 1 example is not sufficient because the content of Si is 4% and too low. It can be seen from the data of No. 2 that, if the contents of C and Mn are held nearly at the upper limits of the present invention (C: 1.20% by weight, Mn: 42.0% by weight), respectively, and about 0.15% P is added, even if the content of Si is about 5%, the good crushability is obtained and that this content of Si is nearly the lower limit. Moreover, if the content of Si exceeds 5%, the necessary contents of C, Mn, and P may be small and, if the content of Si exceeds about 12%, the crushability is good but it is difficult to ensure non-magnetism. Therefore, the range of the Si content was determined to be 5% to 12.0% by weight.

Next, the effect of C will be described. Examples are shown in No. 3, No. 4 and No. 5 in Table 1. It can be seen from the results of No. 3 and No. 4 that, if the content of Si is about 7% by weight and the content of Mn is about 24% by weight and the content of C exceeds 1% by weight, the good crushability is obtained. Moreover, it can be seen from the result of No. 5 that, if the content of C is about 0.4% by weight, the contents of Si and Mn must be increased so as to ensure the stable crushability. As for the upper limit of the C content, even if the content of C exceeds 1.20% by weight, the effect of the C content on the crushability and the non-magnetism does not change and, hence, the range of C content was determined to be 0.40% to 1.20% by weight. As for the content of Mn, the content of Mn has a small effect on the Vickers (coefficient of the above described equation: 10) and hence the effect of the Mn content on the crushability is not so strong as the contents of C and Si, but the content of Mn must be about 19% by weight at the minimum so as to keep this ferroalloy in a non-magnetic stable austenite phase and, if the content of Si having a strong tendency to form ferrite as described above is about 12% by weight, the content of Mn must be not less than 40% by weight and, hence, the range of the Mn content was determined to be 19.0% to 42.0% by weight. An iron alloy according to the present invention may contain P as an unavoidable impurity, and an amount of P up to 0.10% does not give any detrimental effect. Moreover, it became clear for the first time that a small amount of addition of P to the ferroalloy according to the present invention has an extremely good effect on an increase in the Vickers hardness (Hv), that is, the improvement in the crushability. Taking into account other examples and collating data comprehensively, a not less than 0.1% addition of P increases the Vickers hardness (Hv) by about 80. But too much addition of P might degrade the quality of the steel product using the ferroalloy according to the present invention and, hence, the range of the P content in the present invention was determined to be 0.10% to 0.40% by weight.

Up to this point, there have been described the reasons why the contents of C, Si, Mn and P which have an effect on the crushability of the iron base Si—Mn alloy according to the present invention are limited. The ferroalloy according to the present invention can always ensure the good crushability by selecting the balanced combination of each element in the range of the claim to make the Vickers hardness not less than 550. The equation for calculating the above described Vickers hardness is as follows:

$$Hv=380\ C+130\ Si+10\ Mn+[P]-1076 \quad (1)$$

Rearranging the equation (1) by substituting the conditions for obtaining the good crushability, Hv≧550 and [P]=80, the following equation is obtained:

$$Si \geqq 11.89-2.92\ C-0.077\ Mn \quad (2)$$

If the content of P is less than 0.10% by weight, the following equation is obtained:

$$Si \geqq 12.51-2.92\ C-0.077\ Mn$$

To make the Vickers hardness (Hv) not less than 550, it is recommended that the content of Si be increased by about 0.6% by weight as compared with that calculated from the equation (2).

Figure 3A:
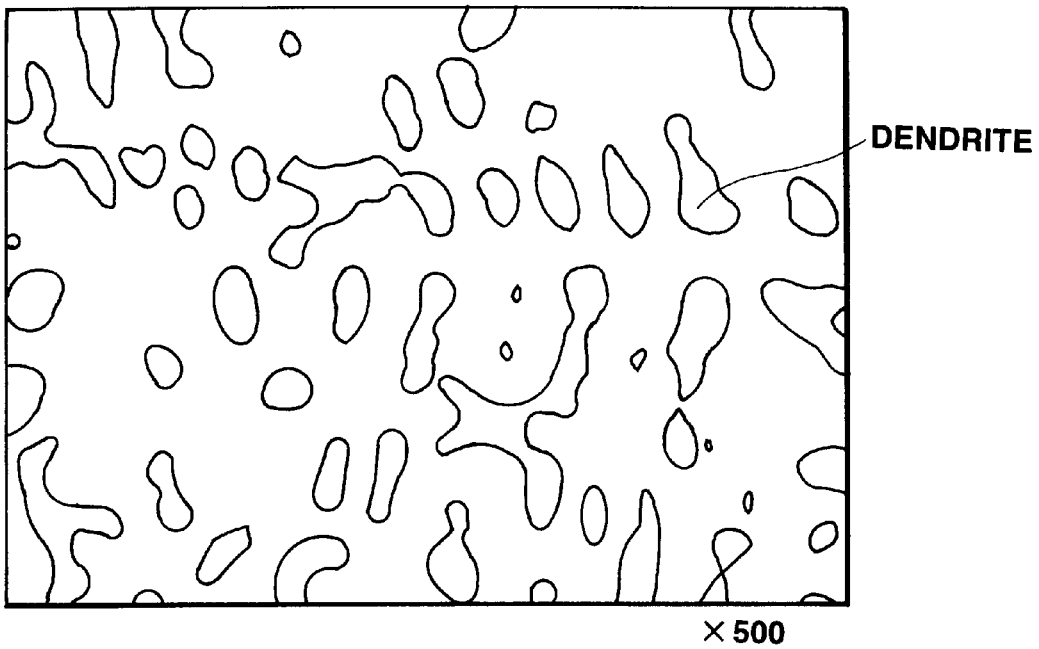
FIGS. 3(*a*) and 3(*b*) show the photographs of solidification structure taken by an optical microscope.
Figure 3B:
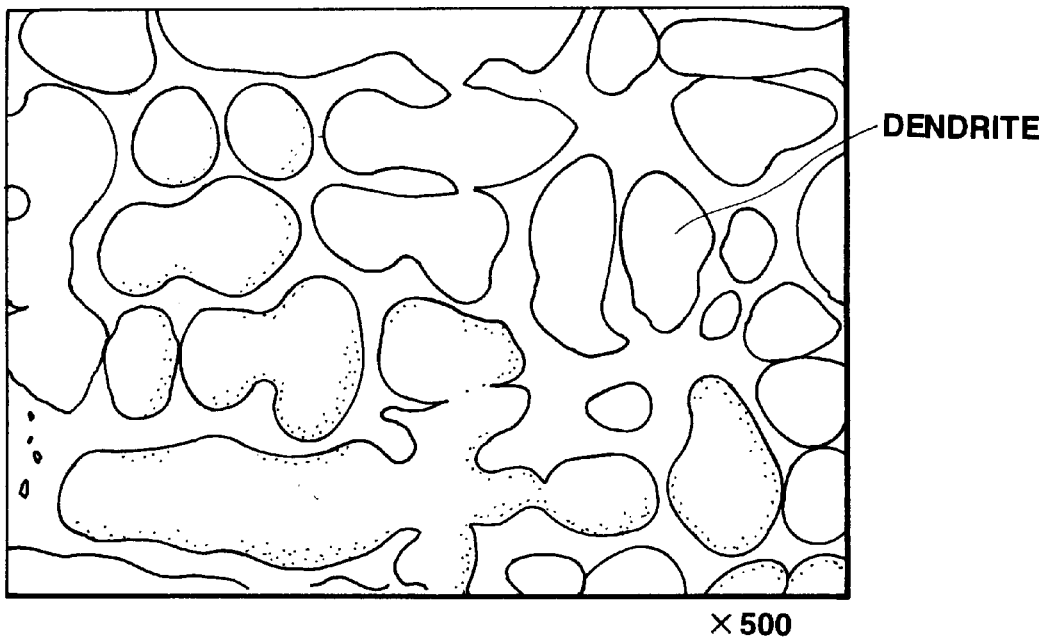

Next, FIG. 1 shows that the small area ratio of dendrite makes the crushability better and the reasons will be now described. FIG. 3 shows the photographs of the solidification structure of the slab taken by an optical microscope. FIG. 3(*a*) shows the structure having the area ratio of dendrite of 24% and the Vickers hardness (Hv) of 682 and the crushability thereof is good. On the other hand, FIG. 3(*b*) shows the structure having the area ratio of dendrite of 73% and the Vickers hardness (Hv) of 347 and the crushability is bad. If a comparison is made between FIG. 3(*a*) and FIG. 3(*b*), the structure of FIG. 3(*b*) is rich in dendrite and, judging from the photograph of the brittle fracture taken by an electron microscope, it is uneven and, as compared with the structure of FIG. 3(*b*), the structure of FIG. 3(*a*) is even. Both brittle fractures have cleavage features. When a crack produced by an external force between the dendrite structures moves and the tip of the crack hits the dendrite structure whose metallurgical property is different, it breaks the dendrite structure and moves on, and hence, the structure rich with dendrite structure needs additional fracture energy in comparison with the structure having scarce dendrite structure. Therefore, a reduction in the area ratio of dendrite has an effect on an improvement in the crushability in addition to the hardness.

Next, the relationship between non-magnetism and composition will be described. It can be seen from FIG. 2 that, if A/F (austenite factor) is not less than 2.80 or 2.40, the ferroalloy is almost completely non-magnetized. Two lines which define the relationship between A/F and α and contain a point (2.80, 0) and a point (2.40, 0), respectively, are expressed by the equations (3) and (4) shown in FIG. 2. Substituting the condition of non-magnetization (α≦0) into the equations (3) and (4), the following equations are obtained:

$$[133-47.4\ (30\ C+0.5\ Mn)/1.5\ Si] \leqq 0 \quad (3')$$

$$[114-47.4\ (30\ C+0.5\ Mn)/1.5\ Si] \leqq 0 \quad (4')$$

Rearranging these equations, the following equations are obtained:

$$Si \leqq 7.1\ C+0.12\ Mn\ (A/F \geqq 2.80)$$

$$Si \leqq 8.3\ C+0.14\ Mn\ (A/F \geqq 2.40) \quad (5)$$

For the ferroalloy according to the present invention to be non-magnetic, the contents of C, Si, and Mn, and the relationship there are controlled by these equations. And it became clear from many experiments that the condition of A/F≧2.40 (equation (5)) is practically sufficient for non-magnetization.

Moreover, the content of Si required for keeping both of the good crushability (Hv≧550) and the non-magnetism (A/F≧2.40) were calculated in the case where the contents of C and Mn were greatly changed by using the above described equations (2) and (5) and the obtained results are shown in Table 2. It can be seen from Table 2 that, if the contents of Si (not more than 12.0% by weight) shown within a bold frame are selected according to the object for the various contents of C, Mn, the good crushability and the non-magnetization can be obtained. As seen from the Table 2, in the present invention, the content of Si plays an important roll to both of the crushability and the non-magnetization.

Up to this point, there have been described the reasons why the contents of C, Si, and Mn which are the fundamental components of the iron base Si—Mn alloy powder according to the present invention are limited and the reasons why a minute amount of P added to the fundamental components are limited. If not more than 1.0% Al and not more than 2.0% Ti are added to the iron base Si—Mn alloy as the other components, they have an effect on a small improvement in the crushability. The other components such as B, Mo, Cr, V, and Nb can be contained in the range that they do not deteriorate the crushability and the non-magnetization.

The relative permeability (μ) of the iron base Si—Mn alloy powder was determined to be not more than 1.10 for the following reasons. The relative permeability (μ) of 1.10 is the limit value where the iron base Si—Mn alloy powder bears magnetism a little and, for example, even if the iron base Si—Mn alloy powder is used as the raw material for the flux used in seam welding in the manufacturing process of a flux cored wire for welding, if the relative permeability (μ) thereof is not more than 1.10, it never produces welding defects. It became clear that, in care of representing a criterion of the relative permeability to the amount of ferrite in slab, the relative permeability (μ) of 1.10 corresponds to the amount of ferrite of 1 to 2% (A/F≧2.40). From these facts, the relative permeability (μ) of the above described alloy powder was determined to be not more than 1.10.

Moreover, the particle size of the iron base Si—Mn alloy powder was determined to be not more than 212 μm for the following reasons. When the iron base Si—Mn alloy powder is used as the raw material for the flux used in the manufacturing process of the flux cored wire for welding, if its particle size is not more than 212 μm, it has merits such as an improvement in manufacturing yield in the wire manufacturing process, the prevention of the segregation of the flux components and a reduction in variations in welding performance. Accordingly, the particle size was determined to be not more than 212 μm.

Next, the crushability and the magnetism where the iron base Si—Mn alloy according to the present invention contains Ni were examined. As a result, it became clear that good crushability and substantial non-magnetism can be ensured in the range of not more than 30% Ni by weight. As the content of Ni is increased, the crushability and the non-magnetization are improved, but the effect of Ni on an increase in the Vickers hardness (Hv) of the slab is a little smaller than that of Mn and the effect of Ni on a decrease in the amount of ferrite (α) is as same as that of Mn.

DESCRIPTION OF THE PREFERRED EMBODIMENTS

EXAMPLE 1

Raw materials blended into a specified composition were molten by a high-frequency induction furnace (melting capacity: 2 kg) and molded into a slab of 10 to 25 mm in thickness. The slab was crushed by a hammer and the crushability was estimated by using a ring mill crushing machine whose shape is shown in FIG. 4.

Figure 4A:
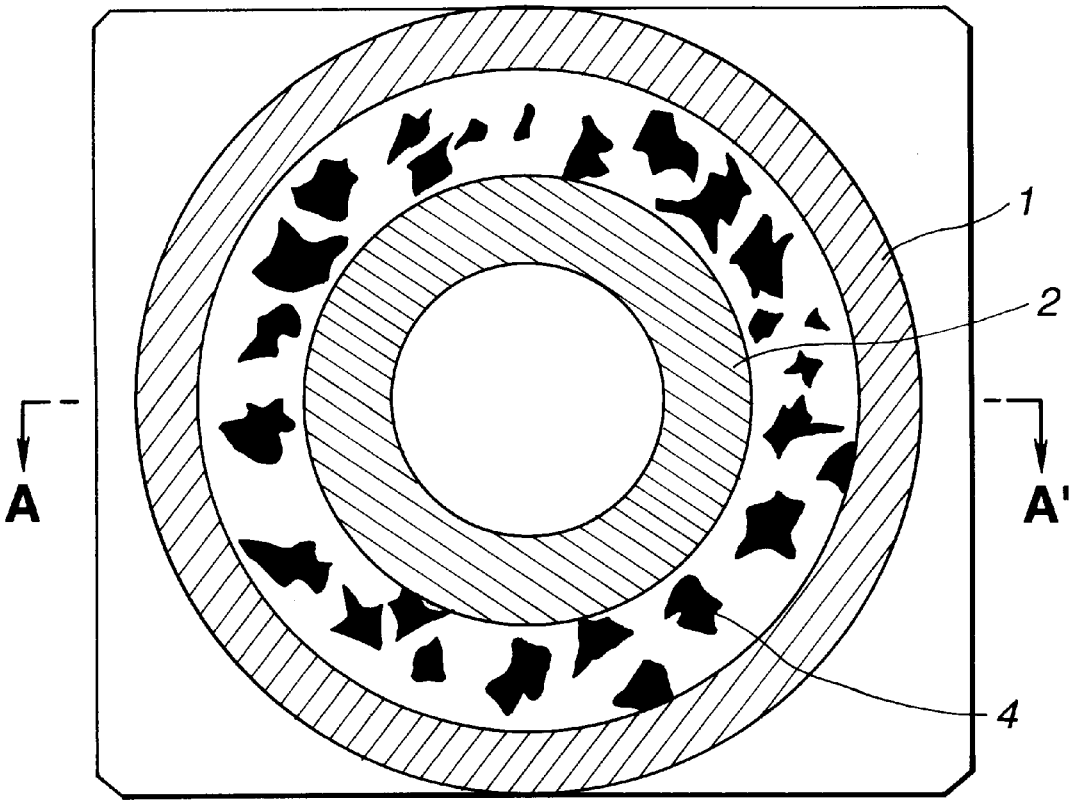
FIGS. 4(*a*) and 4(*b*) are is a schematic view illustrating a ring mill crushing machine used for the estimation of crushability.
Figure 4B:
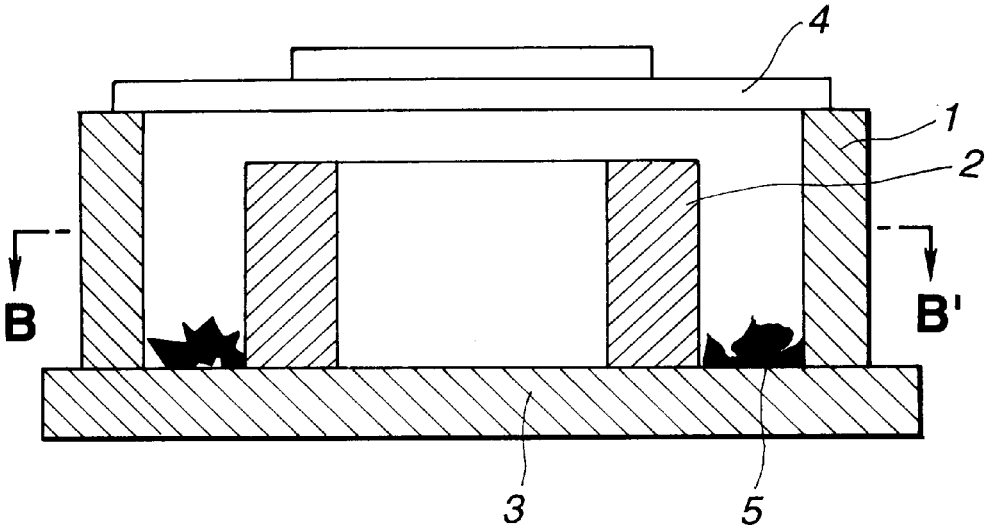

FIG. 4(*a*) is a transverse cross section, taken on line B-B' in FIG. 4(*b*), of the ring mill crushing machine and FIG. 4(*b*) is a vertical cross section, taken on line A-A' in FIG. 4(*a*). An inner ring 2 is put in an outer cylinder 1 integrated with a bottom member 3. If the bottom member 3 is horizontally vibrated under specified conditions, the inner ring 2 is moved and the slab inserted between the outer cylinder 1 and the inner ring 2 is hit and crushed. The crushability was estimated as follows: the slab of about 100 g which was coarsely crushed into blocks (mean block size: 10 to 20 mm) was put in the above described ring mill crushing machine and was vibrated under the conditions of amplitude of vibration 100 mm, vibration frequency 1800/min., and duration 60 sec, and then the case where the ratio of particles of not more than 212 μm in size is not less than 90% was estimated to be extremely good (◎) and the case where the ratio of particles of not more than 212 μm in size is not less than 50% was estimated to be good (○) and the case where the ratio of particles of not more than 212 μm in size is less than 50% was estimated to be insufficient (Δ). The results of the tests are shown in Table 1 and the range of the contents of Si and C are described above. In Table 1, No. 1 is a comparative example and No. 2 to No. 5 are the examples of the present invention and show the good crushability.

EXAMPLE 2

A small amount of raw material (2 kg) was molten by a method similar to the example 1. Table 3 shows the chemical composition of the resulting alloy powder and the results of the examination of the resulting slab (hardness, area ratio of dendrite, amount of ferrite, and crushability). In the examples of No. 1 to No. 12 and No. 18, No. 19 and No. 21, the crushability is good. It can be seen that in the examples of No. 2, No.4, No. 5, No.7, No. 8, No.11, No. 12, and No.21, the amount of ferrite is scarce and thus substantially non-magnetic iron base Si—Mn alloy powder is obtained. In the examples of No. 11 and No. 12, the small amounts of Ti, Al were added. On the other hand, in the comparative examples of No. 13 to No. 17 and No. 20, the crushability is insufficient and in those examples the Vickers hardness (Hv) is less than 550 and the area ratio of dendrite is more than 50%.

No. 18 to No. 21 shows the effect of an addition of P on the Vickers hardness (Hv) and the area ratio of dendrite (%) and, if a comparison is made between No. 18 and No. 19 and between No. 20 and No. 21 whose other compositions are almost the same, it can be understood that the effect of an addition of P is very remarkable.

EXAMPLE 3

A small amount of raw material was molten as in the case of the example 1. Table 4 shows the chemical composition, the magnetism and the other properties of the resulting alloy powder. In No. 1 to No. 4 examples of the present invention, the austenite factor is not less than 2.40 and the amount of ferrite is not more than 0.14%, which shows the good non-magnetism, and the crushability is also good. On the other hand, in No. 5, No. 6, and No. 7 comparative examples, the austenite factor is 1.44, 1.75, or 2.14, respectively, which is lower, and the large amount of ferrite phase is precipitated, which shows that it has the strong magnetism. And it can be seen in these examples that the relationship between the hardness (Hv) and the crushability is abnormal.

EXAMPLE 4

A large amount of raw material was molten by a high-frequency induction furnace (melting capacity 250 kg) to further check the effect of the present invention. Raw material was molten and molded into a slab of 20 to 50 mm in thickness.

The slab was coarsely crushed by a jaw crusher and then finely crushed by a rod mill and then sieved by a sieve with a mesh 212 μm. The alloy powder was made like this process. Table 5 shows the chemical composition, the particle size distribution, and the relative permeability (μ) of the obtained alloy powder measured by a vibration sample type magnetometer and the Vickers hardness (Hv), the area ratio of dendrite (%) and the amount of ferrite of the slab measured by a ferrite meter (%). As a result, it can be seen from the data shown in Table 5 that No. 1, No. 2, and No. 3 examples which correspond to the claims of the present invention have the sufficient crushability and the small relative permeability (μ) in a conventional mechanical crushing method. This shows that the results of the tests using a large amount of raw material are the same as of the tests using a small amount of raw material.

EXAMPLE 5

The alloy powder containing Ni was made by using a high-frequency induction furnace (melting capacity 250 kg) and a method similar to the example 4. Table 6 shows the chemical composition, the particle size distribution, and the relative permeability (μ) of the obtained alloy powder, and the Vickers hardness (Hv), the area ratio of dendrite (%) and the amount of ferrite of the slab thereof (%). As a result, it can be seen that all No. 1 to No. 7 examples containing Ni can be easily crushed by a mechanical crushing method and No. 1 to No. 5 examples have the relative permeability (μ) of not more than 1.10 and hence are substantially non-magnetized. In No. 5 example, the coarse particles of not less than 212 μm size were produced by 9%, but they were crushed again by the rod mill crushing machine and could be completely made small particles of not more than 212 μm size.

As described above, according to the present invention, the iron base Si—Mn alloy powder or the iron base Si—Mn—Ni alloy powder which has a high iron content and is substantially non-magnetic can be manufactured extremely crushably, easily and in large quantity in the manufacturing process.

TABLE 1

| | chemical composition (wt %) | | | | Vickers hardness | | area ratio of dendrite |
|---|---|---|---|---|---|---|---|
| No | C | Si | Mn | P | (Hv) | crushability | (%) |
| 1 | 1.25 | 4.4 | 43.6 | 0.15 | 492 | Δ | 55 |
| 2 | 1.17 | 5.4 | 40.7 | 0.11 | 572 | ○ | 44 |
| 3 | 1.18 | 7.0 | 24.6 | 0.10 | 663 | ◎ | 40 |
| 4 | 1.03 | 7.0 | 24.8 | 0.13 | 568 | ○ | 50 |
| 5 | 0.43 | 8.5 | 27.4 | 0.34 | 564 | ○ | 47 |

TABLE 2

| | Si (%) | | | | | |
|---|---|---|---|---|---|---|
| | Mn = 20% | | Mn = 30% | | Mn = 40% | |
| C (%) | Hv ≧ 550 | A/F ≧ 2.40 | Hv ≧ 550 | A/F ≧ 2.40 | Hv ≧ 550 | A/F ≧ 2.40 |
| 0.40 | 9.2≦ | ≦6.1 | 8.4≦ | ≦7.5 | 7.6≦ | ≦8.9 |
| 0.80 | 8.0≦ | ≦9.4 | 7.2≦ | ≦10.8 | 6.5≦ | ≦12.2 |
| 1.20 | 6.9≦ | ≦12.8 | 6.1≦ | ≦14.2 | 5.3≦ | ≦15.0 |

(%, weight %)

TABLE 3

| | Chemical composition (wt %) | | | | | Vickers hardness (Hv) | | area ratio of | amount of | | |
|---|---|---|---|---|---|---|---|---|---|---|---|
| | | | | | | measured | calculated | dendrite | ferrite | | |
| No. | C | Si | Mn | P | S | value | value | (%) | (%) | crushability | notes |
| 1 | 0.51 | 8.7 | 30.5 | 0.03 | 0.002 | 560 | 554 | 50 | — | ◎ | invention |
| 2 | 0.52 | 8.9 | 32.9 | 0.04 | 0.029 | 614 | 608 | 36 | 0.09 | ◎ | |
| 3 | 1.18 | 7.0 | 24.6 | 0.10 | 0.005 | 663 | 608 | 40 | — | ◎ | |
| 4 | 0.60 | 9.2 | 32.3 | 0.16 | 0.003 | 706 | 751 | 41 | 0.05 | ◎ | |
| 5 | 0.59 | 8.8 | 32.3 | 0.13 | 0.003 | 729 | 695 | 34 | 0.01 | ◎ | |
| 6 | 0.44 | 9.1 | 34.2 | 0.17 | 0.002 | 737 | 696 | 24 | — | ◎ | |
| 7 | 0.61 | 9.2 | 33.8 | 0.13 | 0.038 | 755 | 770 | 21 | 0.03 | ◎ | |
| 8 | 0.52 | 9.3 | 37.2 | 0.12 | 0.004 | 779 | 783 | 21 | 0.5 | ◎ | |
| 9 | 0.50 | 10.1 | 40.5 | 0.04 | 0.006 | 800< | 832 | 11 | 4.5 | ◎ | |
| 10 | 0.42 | 11.8 | 41.5 | 0.05 | 0.002 | 800< | 1033 | 10 | 17 | ◎ | |
| 11 | 0.80 | 8.3 | 24.7 | 0.16 | 0.002 | 592 | 634 | 45 | 0.03 | ◎ | |
| 12 | 0.58 | 8.6 | 33.3 | 0.12 | Ti:1.13 0.003 Al:0.50 | 638 | 675 | 45 | 0.09 | ◎ | |
| 13 | 0.48 | 7.2 | 22.3 | 0.16 | 0.053 | 367 | 345 | 74 | 3.5 | Δ | comparison |
| 14 | 0.83 | 7.0 | 24.5 | 0.15 | 0.006 | 471 | 474 | 53 | — | Δ | |
| 15 | 0.46 | 7.6 | 32.4 | 0.16 | 0.002 | 497 | 491 | 51 | 0.01 | Δ | |
| 16 | 1.25 | 4.4 | 43.6 | 0.15 | 0.004 | 492 | 487 | 55 | 0.00 | Δ | |
| 17 | 0.68 | 7.9 | 29.8 | 0.06 | 0.005 | 528 | 507 | 54 | — | Δ | |
| 18 | 0.51 | 8.9 | 32.4 | 0.03 | 0.004 | 581 | 599 | 43 | — | ◎ | invention |
| 19 | 0.51 | 9.0 | 32.4 | 0.15 | 0.003 | 690 | 692 | 33 | — | ◎ | |
| 20 | 0.46 | 8.1 | 31.6 | 0.05 | 0.002 | 446 | 468 | 55 | 0.03 | Δ | comparison |
| 21 | 0.47 | 8.2 | 32.7 | 0.13 | 0.002 | 578 | 576 | 40 | 0.02 | ○ | invention |

TABLE 4

| No | C | Si | Mn | P | S | Vickers hardness (Hv) measured value | Vickers hardness (Hv) calculated value | area ratio of dendrite (%) | magnetism A/F | magnetism amount of ferrite (%) | crushability | notes |
|---|---|---|---|---|---|---|---|---|---|---|---|---|
| | chemical composition (wt %) | | | | | | | | | | | |
| 1 | 0.68 | 8.2 | 30.9 | 0.06 | 0.003 | 576 | 557 | 41 | 2.92 | 0.14 | ○ | invention |
| 2 | 0.52 | 8.6 | 32.9 | 0.04 | 0.029 | 614 | 608 | 36 | 2.40 | 0.09 | ◎ | |
| 3 | 0.59 | 8.8 | 32.3 | 0.13 | 0.003 | 739 | 695 | 34 | 2.57 | 0.01 | ◎ | |
| 4 | 0.61 | 9.2 | 33.8 | 0.13 | 0.038 | 755 | 770 | 21 | 2.55 | 0.03 | ◎ | |
| 5 | 0.30 | 9.7 | 23.9 | 0.05 | 0.003 | 614 | 564 | — | 1.44 | 63 | Δ | comparison |
| 6 | 0.36 | 8.9 | 25.2 | 0.30 | 0.020 | 465 | 550 | 58 | 1.75 | 22 | Δ | |
| 7 | 0.59 | 8.8 | 21.0 | 0.27 | 0.018 | 507 | 582 | — | 2.14 | 21 | Δ | |

TABLE 5

| No | C | Si | Mn | P | S | Ratio of particle size of not more than 212 μm (%) | relative permeability (μ) | slab hardness (Hv) | slab area ratio of dendrite (%) | slab amount of ferrite (%) | crushability | notes |
|---|---|---|---|---|---|---|---|---|---|---|---|---|
| | chemical composition (wt %) | | | | | | | | | | | |
| 1 | 0.61 | 9.1 | 32.2 | 0.16 | 0.003 | 100 | 1.06 | 785 | 18 | 0.05 | ◎ | example in the tests of large quantity. |
| 2 | 0.59 | 8.3 | 34.0 | 0.06 | 0.004 | 100 | 1.02 | 647 | 36 | 0.00 | ◎ | |
| 3 | 0.47 | 8.2 | 32.7 | 0.13 | 0.002 | 82 | 1.03 | 570 | 48 | 0.01 | ○ | |

TABLE 6

| No | C | Si | Mn | P | S | Ni | Ratio of particle size of not more than 212 μm (%) | relative permeability (μ) | slab hardness (Hv) | slab area ratio of dendrite (%) | slab amount of ferrite (%) | crushability | notes |
|---|---|---|---|---|---|---|---|---|---|---|---|---|---|
| | chemical composition (wt %) | | | | | | | | | | | | |
| 1 | 0.67 | 8.3 | 31.5 | 0.23 | 0.003 | 2.0 | 100 | 1.02 | 671 | 38 | 0.01 | ◎ | example in the tests of large quantity. |
| 2 | 0.61 | 8.0 | 29.1 | 0.24 | 0.003 | 9.6 | 100 | 1.05 | 647 | 26 | 0.12 | ◎ | |
| 3 | 0.68 | 8.2 | 31.2 | 0.05 | 0.003 | 11.0 | 100 | 1.04 | 658 | 40 | 0.18 | ◎ | |
| 4 | 1.08 | 9.1 | 32.6 | 0.33 | 0.003 | 18.0 | 100 | 1.04 | >800 | 24 | 0.13 | ◎ | |
| 5 | 0.40 | 7.2 | 30.0 | 0.10 | 0.003 | 23.6 | 91 | 1.02 | 607 | 43 | 0.08 | ◎ | |
| 6 | 0.53 | 10.9 | 20.3 | 0.22 | 0.003 | 10.0 | 100 | — | >800 | 31 | 31 | ◎ | |
| 7 | 0.44 | 10.4 | 21.1 | 0.05 | 0.007 | 19.3 | 100 | — | 784 | 24 | 10 | ◎ | |

What is claimed is:

1. An iron base Si—Mn alloy having good crushability, comprising:

C: 0.40 to 1.20% by weight,

Si: 5.0 to 12.0% by weight,

Mn: 19.0 to 42.0 % by weight, and the balance being Fe and unavoidable impurities, with the following equations satisfied:

$Si \geqq 12.51-2.92\ C-0.077\ Mn$,

Vickers hardness (Hv)≧550, and area ratio of dendrite structure≦50%.

2. An iron base Si—Mn alloy having good crushability, comprising:

C: 0.40 to 1.20% by weight,

Si: 5.0 to 12.0% by weight,

Mn: 19.0 to 42.0% by weight, and the balance being Fe and unavoidable impurities, with the following equations satisfied:

$Si \geqq 12.51-2.92\ C-0.077\ Mn$, $Si \leqq 8.3\ C+0.14\ Mn$,

Vickers hardness (Hv)≧550, area ratio of dendrite structure ≦50%, and relative permeability (μ)≦1.10.

3. Iron base Si—Mn alloy powder made of said iron base Si—Mn alloy having good crushability as in claim 1, wherein a particle size is not more than 212 μm.

4. An iron base Si—Mn alloy having good crushability as in claim 1, further comprising not more than 30% by weight of Ni.

5. Iron base Si—Mn—Ni alloy powder made of said iron base Si—Mn—Ni alloy having good crushability as in claim 4, wherein a particle size is not more than 212 μm.

6. An iron base Si—Mn alloy having good crushability, comprising,

C: 0.40 to 1.20% by weight,

Si: 5.0 to 12.0% by weight,

Mn: 19.0 to 42.0% by weight,

P: 0.10 to 0.40% by weight, and the balance being Fe and unavoidable impurities, with the following equations being satisfied:

$$Si \geqq 11.89-2.92\ C-0.077\ Mn,$$

Vickers hardness (Hv)≧550, and area ratio of dendrite structure≦50%.

7. An iron base Si—Mn alloy having good crushability, comprising:

C: 0.40 to 1.20% by weight,

Si: 5.0 to 12.0% by weight,

Mn: 19.0 to 42.0% by weight,

P: 0.10 to 0.40% by weight, and the balance being Fe and unavoidable impurities, with the following equations being satisfied:

$$Si \geqq 11.89-2.92\ C-0.077\ Mn,$$

$$Si \leqq 8.3\ C+0.14\ Mn,$$

Vickers hardness (Hv)≧550, area ratio of dendrite structure≦50%, and relative permeability ($\mu$)≦1.10.

8. Iron base Si—Mn alloy powder made of said iron base Si—Mn alloy having good crushability as in claim 2, wherein a particle size is not more than 212 $\mu$m.

9. Iron base Si—Mn alloy powder made of said iron base Si—Mn alloy having good crushability as in claim 6, wherein a particle size is not more than 212 $\mu$m.

10. Iron base Si—Mn alloy powder made of said iron base Si—Mn alloy having good crushability as in claim 7, wherein a particle size is not more than 212 $\mu$m.

11. An iron base Si—Mn alloy having good crushability as in claim 2, further comprising not more than 30% by weight of Ni.

12. An iron base Si—Mn alloy having good crushability as in claim 6, further comprising not more than 30% by weight of Ni.

13. An iron base Si—Mn alloy having good crushability as in claim 7, further comprising not more than 30% by weight of Ni.

14. Iron base Si—Mn—Ni alloy powder made of said iron base Si—Mn—Ni alloy having good crushability as in claim 11, wherein a particle size is not more than 212 $\mu$m.

15. Iron base Si—Mn—Ni alloy powder made of said iron base Si—Mn—Ni alloy having good crushability as in claim 12, wherein a particle size is not more than 212 $\mu$m.

16. Iron base Si—Mn—Ni alloy powder made of said iron base Si—Mn—Ni alloy having good crushability as in claim 13, wherein a particle size is not more than 212 $\mu$m.

* * * * *